US008579339B2

(12) United States Patent
Abe

(10) Patent No.: US 8,579,339 B2
(45) Date of Patent: Nov. 12, 2013

(54) STRUCTURE FOR OUTSIDE DOOR HANDLE OF VEHICLES

(75) Inventor: Keita Abe, Hiratsuka (JP)

(73) Assignee: Nissan Motor Co., Ltd., Kanagawa (JP)

( * ) Notice: Subject to any disclaimer, the term of this patent is extended or adjusted under 35 U.S.C. 154(b) by 434 days.

(21) Appl. No.: 12/414,342

(22) Filed: Mar. 30, 2009

(65) Prior Publication Data

US 2009/0256366 A1 Oct. 15, 2009

(30) Foreign Application Priority Data

Apr. 11, 2008 (JP) ..... 2008-103821
Dec. 24, 2008 (JP) ..... 2008-327632

(51) Int. Cl.
*E05B 3/00* (2006.01)

(52) U.S. Cl.
USPC ..... 292/336.3; 292/DIG. 53; 292/216; 292/346; 292/347

(58) Field of Classification Search
USPC ..... 292/216, 336.3, 346, 347, DIG. 2, 292/DIG. 53; 70/208, 210, 416, 417, 423, 70/452, 455
See application file for complete search history.

(56) References Cited

U.S. PATENT DOCUMENTS 2,629,248 A * 2/1953 Burdick ..... 70/370
4,397,168 A * 8/1983 Rotondi et al. ..... 70/417
5,410,899 A * 5/1995 McConnell ..... 70/370
5,435,609 A * 7/1995 Igata et al. ..... 292/346
5,477,712 A * 12/1995 Hill ..... 70/417
5,499,851 A * 3/1996 Mitchell ..... 292/347
5,676,002 A * 10/1997 Hoeptner, III ..... 70/416
5,709,420 A * 1/1998 Umino ..... 292/216
5,987,942 A 11/1999 Ichinose
6,141,914 A * 11/2000 Feige et al. ..... 49/503
6,240,754 B1 * 6/2001 Petersen ..... 70/417
6,241,294 B1 * 6/2001 Young et al. ..... 292/336.3
6,264,257 B1 * 7/2001 Meinke ..... 292/336.3

(Continued)

FOREIGN PATENT DOCUMENTS

GB 2297122 A 7/1996
GB 2415743 A 1/2006
JP 9-207569 A 8/1997
JP 10008793 1/1998

OTHER PUBLICATIONS

Office Action in Korean Patent Application No. 10-2009-0031062, dated Jul. 29, 2010 (3 pages).

(Continued)

*Primary Examiner* — Carlos Lugo
*Assistant Examiner* — Mark Williams
(74) *Attorney, Agent, or Firm* — Osha Liang LLP

(57) ABSTRACT

An outside handle assembly of a vehicle door includes an escutcheon disposed in the outer panel of the vehicle door, a handle body disposed at a vehicular outer side of the escutcheon, a first protection bracket disposed at the vehicular inner side of the escutcheon, the first protection bracket comprising an engaging hole configured to receive a key cylinder, and a second protection bracket disposed at the vehicular inner side of the escutcheon to cover a periphery of the key cylinder, wherein the second protection bracket is coupled to the inner panel of the vehicle door and comprises at least one support contacting the first protection bracket, and wherein the second protection bracket is arranged to receive an impact load exerted upon the first protection bracket toward the vehicular inner side.

13 Claims, 8 Drawing Sheets

(56) References Cited

U.S. PATENT DOCUMENTS

| | | | | |
|---|---|---|---|---|
| 6,530,251 | B1 * | 3/2003 | Dimig | 70/237 |
| 6,550,295 | B2 * | 4/2003 | Hubner | 70/208 |
| 6,571,516 | B2 * | 6/2003 | Nakamoto et al. | 49/503 |
| 6,843,085 | B2 * | 1/2005 | Dimig | 70/237 |
| 7,140,076 | B2 * | 11/2006 | Hsu | 16/414 |
| 7,192,076 | B2 * | 3/2007 | Ottino | 296/146.1 |
| 7,360,809 | B1 * | 4/2008 | Poston | 292/340 |
| 7,752,877 | B2 * | 7/2010 | Burns | 70/208 |
| 2006/0119114 | A1 * | 6/2006 | Kreitz et al. | 292/346 |

OTHER PUBLICATIONS

English Patent Abstract of JP9207569 from esp@cenet, published Aug. 12, 1997 (1 page).

Extended European Search Report for Application No. 09157694.2, mailed on Jun. 19, 2012 (6 pages).

* cited by examiner

STRUCTURE FOR OUTSIDE DOOR HANDLE OF VEHICLES

CROSS-REFERENCE TO RELATED APPLICATIONS

The present application claims priority from Japanese Patent Application No. 2008-103821, filed Apr. 11, 2008 and Japanese Patent Application No. 2008-327632, filed Dec. 24, 2008. The contents of both priority applications are hereby incorporated by reference in their entirety.

BACKGROUND OF THE DISCLOSURE

1. Field of the Disclosure

The present disclosure relates to a structure of an outside door handle of a vehicle provided with an escutcheon.

2. Description of the Related Art

In a conventional structure for an outside door handle of a vehicle, an insertion cylinder protrudes from an outer handle case (escutcheon) provided in a door outer panel towards an inside of the vehicle. Further, a key cylinder is inserted into the insertion cylinder.

In the structure of the outside door handle, a screwdriver may be inserted into a key hole of the key cylinder, and a force applied to thereby displace the key cylinder to a direction orthogonal to a shaft direction of the key cylinder, the key cylinder may be dislocated (i.e., displacement perpendicular to the shaft direction). Thus, a doorlock may be improperly released.

Thus, in order to prevent such an improper release, Japanese Laid-Open Patent Publication No. (Hei) 10-8793 discloses a preventive measure against burglaries. Specifically, a U-shaped engaging plate (key cylinder protection bracket) may be disposed at an outer side of the insertion cylinder which prevents the key cylinder from being dislocated by the U-shaped engaging plate (see pages 2 and 3 as well as FIG. 5).

Although the improper release of the doorlock caused by the insertion of the screwdriver into the key hole may be prevented, other types of improper releases may not be prevented. Because the escutcheon may be formed from synthetic resin, the doorlock may be improperly released by dislocating or destroying the key cylinder with a hammer from outside the vehicle.

Thus, the present disclosure is directed to providing an outside door handle of a vehicle capable of preventing an improper release of the doorlock caused by striking the key cylinder with a hammer or similar device.

SUMMARY OF THE CLAIMED SUBJECT MATTER

In one aspect, embodiments disclosed herein relate to an outside handle assembly of a vehicle door having an inner panel and an outer panel including an escutcheon disposed in the outer panel of the vehicle door, a handle body disposed at a vehicular outer side of the escutcheon, a first protection bracket disposed at the vehicular inner side of the escutcheon, the first protection bracket comprising an engaging hole configured to receive a key cylinder, and a second protection bracket disposed at the vehicular inner side of the escutcheon to cover a periphery of the key cylinder, wherein the second protection bracket is coupled to the inner panel of the vehicle door and comprises at least one support contacting the first protection bracket, and wherein the second protection bracket is arranged to receive an impact load exerted upon the first protection bracket toward the vehicular inner side.

In another aspect, embodiments disclosed herein relate to a method to protect an outside door handle assembly of a vehicle door including disposing an escutcheon in an outer panel of the vehicle door, disposing a handle body at a vehicular outer side of the escutcheon, disposing a first protection bracket at the vehicular inner side of the escutcheon, disposing a second protection bracket at the vehicular inner side of the escutcheon to cover a periphery of a key cylinder, coupling the second protection bracket to an inner panel of the vehicle door, and contacting the first protection bracket with at least one support of the second protection bracket.

In another aspect, embodiments disclosed herein relate to a handle assembly of a vehicle door having an inner panel and an outer panel including an escutcheon disposed in the outer panel of the vehicle door, a handle body disposed at a vehicular outer side of the escutcheon, a first means for protecting a key cylinder disposed at the vehicular inner side of the escutcheon, the first protecting means comprising an engaging hole configured to receive the key cylinder, and a second means for protecting the key cylinder disposed at the vehicular inner side of the escutcheon to cover a periphery of the key cylinder, wherein the second protecting means is coupled to the inner panel of the vehicle door and comprises at least one support contacting the first protecting means, and wherein the second protecting means is arranged to receive an impact load exerted upon the first protecting means toward the vehicular inner side.

BRIEF DESCRIPTION OF DRAWINGS

Features of the present disclosure will become more apparent from the following description in conjunction with the accompanying drawings.

DETAILED DESCRIPTION

Hereinafter, embodiments of the present disclosure will be explained with reference to the drawings.

FIGS. 1 to 8 illustrate a structure of an outside door handle of a vehicle according to the present disclosure.

Figure 3:
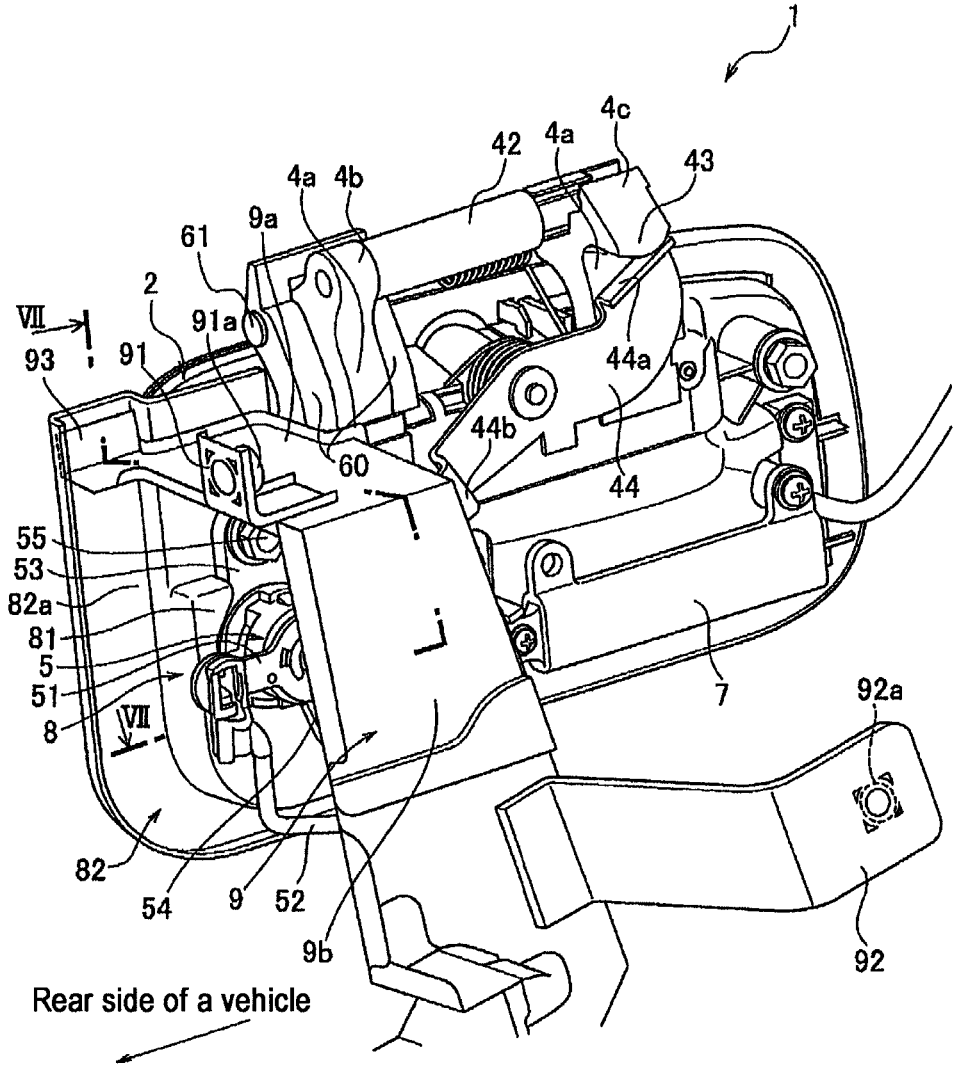
FIG. 3 is a perspective view of an inner side of the outside door handle provided with a protector when seen from a rear side of a vehicle according to one embodiment of the present disclosure.
Figure 4:
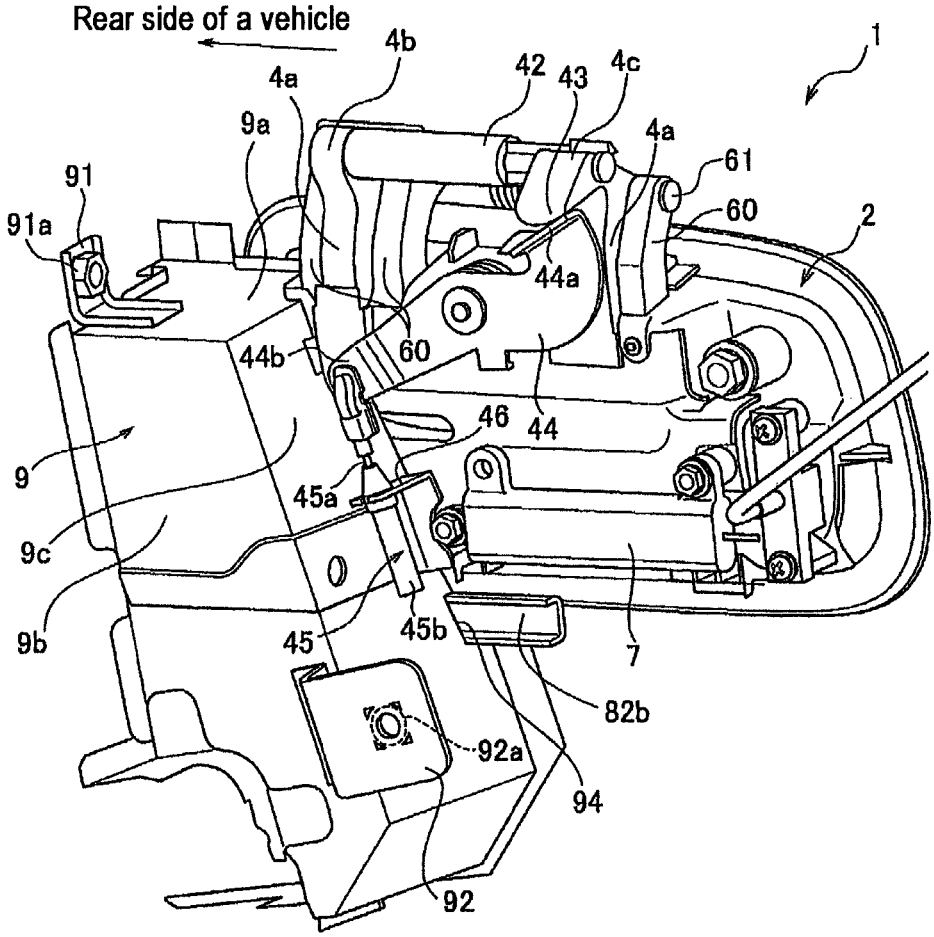
FIG. 4 is a perspective view of an inner side of the outside door handle provided with a protector when seen from a front side of a vehicle according to one embodiment of the present disclosure.
Figure 5:
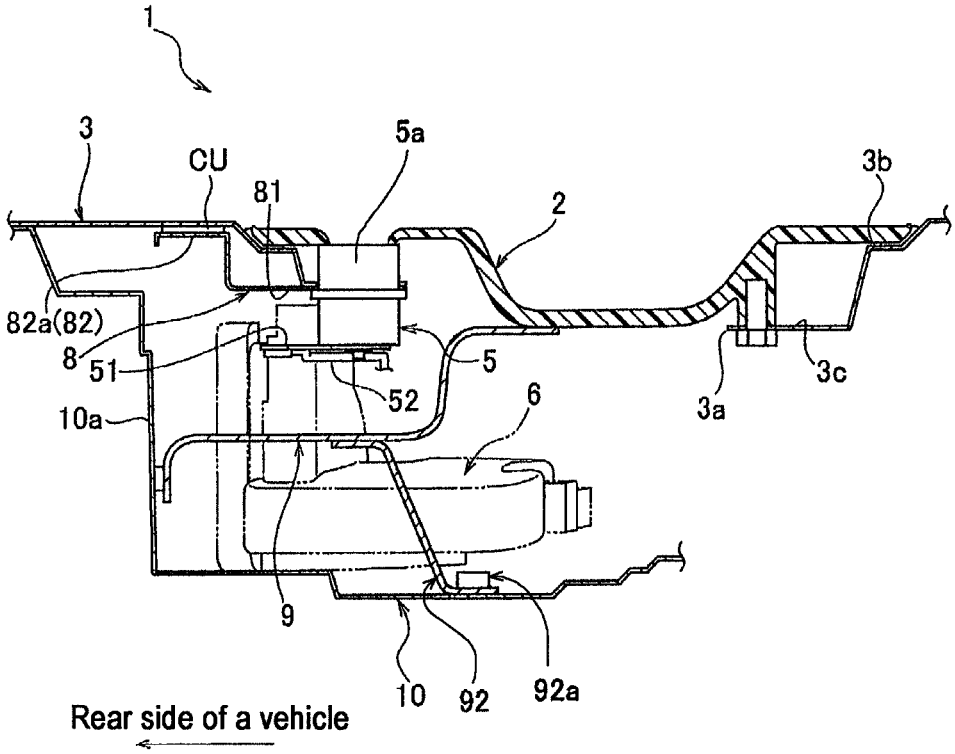
FIG. 5 is a cross-sectional view of the outside door handle cut along a horizontal direction when seen from an top side of a vehicle according to one embodiment of the present disclosure.

As shown in FIGS. 1 to 5, an outside door handle 1 of the present disclosure may include an escutcheon 2 formed from synthetic resin. The escutcheon 2 may have an approximately rectangular shape (shown in FIG. 8) with rounded four corners. The escutcheon 2 may be installed at an outer stepped profile 3*b* and an inner stepped profile 3c formed in a door outer panel 3 (shown in FIG. 5). An installation opening 3*a* may be formed at the inner stepped profile 3*c*. Further, the installation opening 3*a* may be recessed from a surface of the door outer panel 3 toward a vehicular inner side. As shown in FIG. 5, an outer periphery of the escutcheon contacts the outer stepped profile 3*b* from a vehicular outer side.

Figure 8:
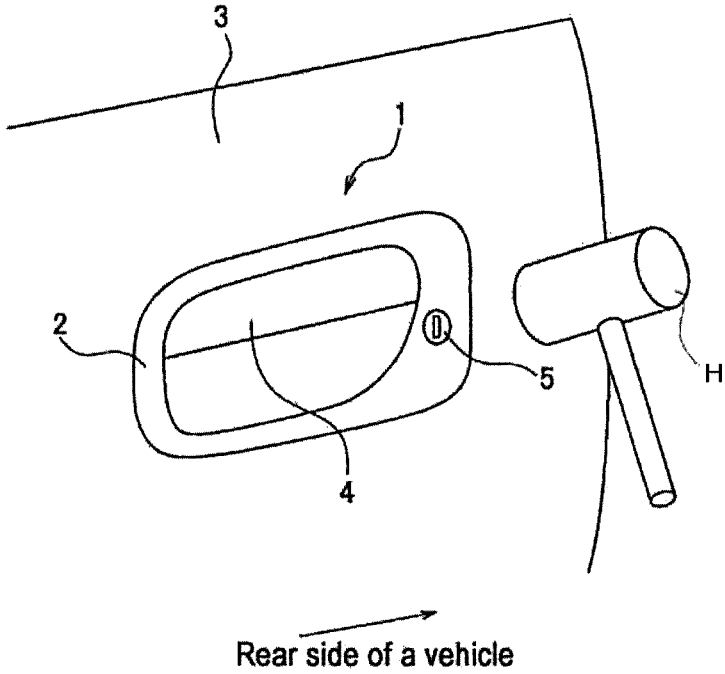
FIG. 8 is a perspective view of the outside door handle seen from an outer side of a vehicle when a hammer is about to strike the key cylinder.

A handle body 4 for opening and closing a door may be disposed at a vehicular outer side of the escutcheon 2 as shown in FIG. 8.

The handle body 4 may be provided with a handle arm 4a. The handle arm 4*a* passes through the escutcheon 2 and extends toward the vehicular inner side as shown in FIGS. 1 to 4. The handle arm 4*a* may be pivotally supported at a rotary shaft 61. The rotary shaft 61 may be secured to a mount 60 which protrudes from an inner surface of the escutcheon 2. Protrusions 4*b* and 4*c* extend from the handle arm 4*a* and a counter weight 42 may be mounted between the protrusions 4*b* and 4*c*. A pressing means 43 extends from a leading end of the protrusion 4*b* at one side of the handle arm 4*a*. When the handle body 4 is pulled toward the vehicular outer direction, the pressing means 43 is pushed downward. Interlocking therewith, one end 44*a* of a lever 44, which may be pivotally supported at the escutcheon, is pushed downward. Accordingly, because the other end 44*b* of the lever 44 is pushed upward, an inner cable 45*a* of a push-and-pull wire 45 is pulled upward. A leading end of the push-and-pull wire 45 may be rotatably and pivotally supported at the other end 44*b*.

The push-and-pull wire 45 may be connected to a doorlock apparatus 6 for locking and releasing the doorlock by a striker (not shown). When an inner cable 45*a* of the push-and-pull wire 45 is pulled upward as described above, the push-and-pull wire 45 may be configured to release a locking of the striker to allow the door to be opened. Further, one end of an outer tube 45*b* of the push-and-pull wire 45 may be secured to the escutcheon 2 via a bracket 46, the other end (not shown) may be secured to a casing side of the doorlock apparatus 6.

Moreover, the escutcheon 2 may be provided with a key cylinder 5.

Figure 1:
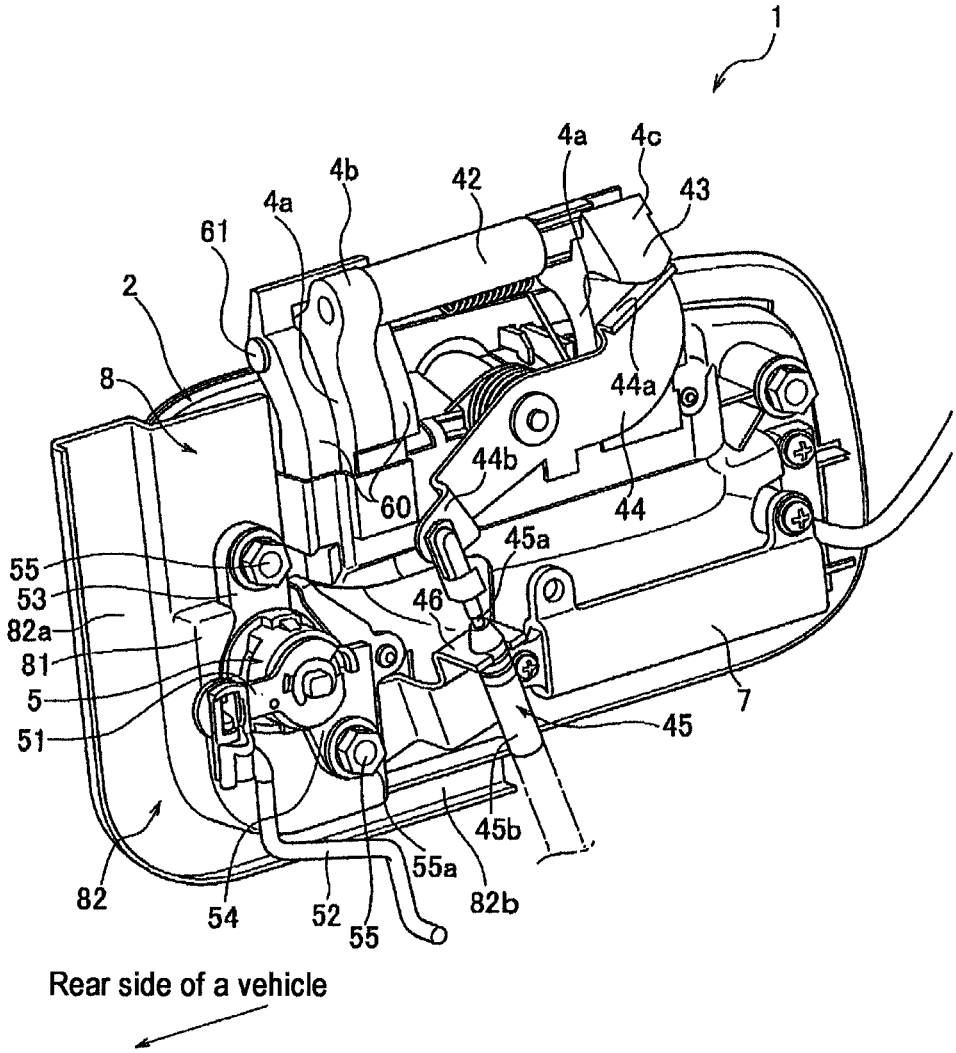
FIG. 1 is a perspective view showing an inner side of an outside door handle according to one embodiment of the present disclosure.

As shown in FIGS. 1 and 5, the key cylinder 5 includes a leading end which protrudes toward a vehicular inner side of the escutcheon 2, and a key lever 51 may be secured to the leading end of the key cylinder 5. When the key is inserted into the key cylinder 5 and then rotated, the key lever 51 rotates with the leading end. A key rod 52, which may be connected to the doorlock apparatus 6 (shown in FIG. 5), is connected to a free end side of the key lever 51.

According to such a configuration, when the key is inserted into the key cylinder 5 and then rotated to one direction (locking-rotation), the doorlock can be locked by the doorlock apparatus 6. Further, when the key is inserted into the key cylinder 5 and then rotated to another direction (releasing-rotation), the doorlock can be released by the doorlock apparatus 6.

Further, a receiver 7 of a keyless entry may be disposed at the vehicle bottom side of the vehicular inner side of the escutcheon 2. If the receiver 7 detects an electronic key or receives a signal from an electronic key, then the doorlock may be released by the doorlock apparatus 6.

As shown in FIG. 1, a key cylinder protection bracket (or first protection bracket) 8 may be disposed on the vehicle inner side of the vehicle and adjacent to the escutcheon 2 and on the periphery of the key cylinder 5. The key cylinder protection bracket 8 may prevent the key cylinder 5 from being displaced along a direction perpendicular to a shaft of the key cylinder.

Figure 2:
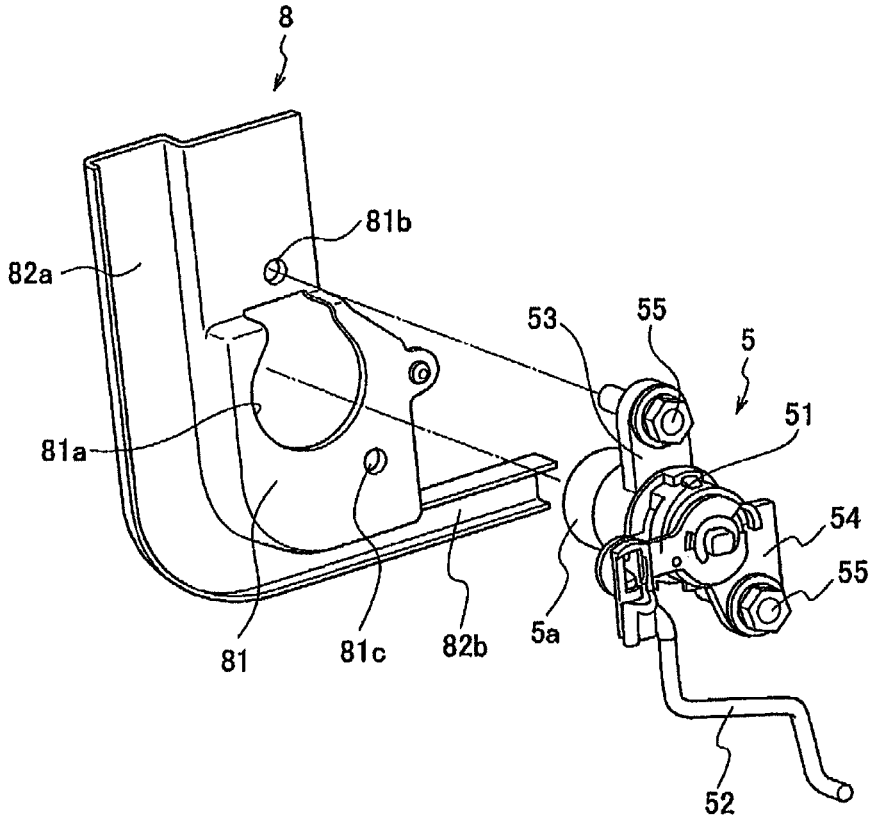
FIG. 2 is an exploded perspective view showing a key cylinder and a key cylinder protection bracket shown in FIG. 1.

As shown in FIG. 2, the key cylinder protection bracket 8 may be substantially L-shaped when viewed from the inside of the vehicle and may be provided with a projection 81 recessed toward the vehicular inner side. The projection 81 may define an engaging hole 81*a* having a substantially circular shape. An end 5*a* of the key cylinder 5, having an arc shape corresponding to the engaging hole 81*a*, may be inserted into the engaging hole 81*a* and coupled to the key cylinder protection bracket 8. Specifically, when the end 5*a* of the key cylinder 5 is inserted into the engaging hole 81*a*, because there may be only a slight gap between an outer peripheral surface of the end 5*a* and an inner peripheral surface of the engaging hole 81*a*, the outer peripheral surface of the end 5*a* interferes with the inner peripheral surface of the engaging hole 81*a* to deter the dislocation of the key cylinder 5 if a force is applied to the key cylinder 5 in an attempt to dislocate the key cylinder 5.

Figure 6:
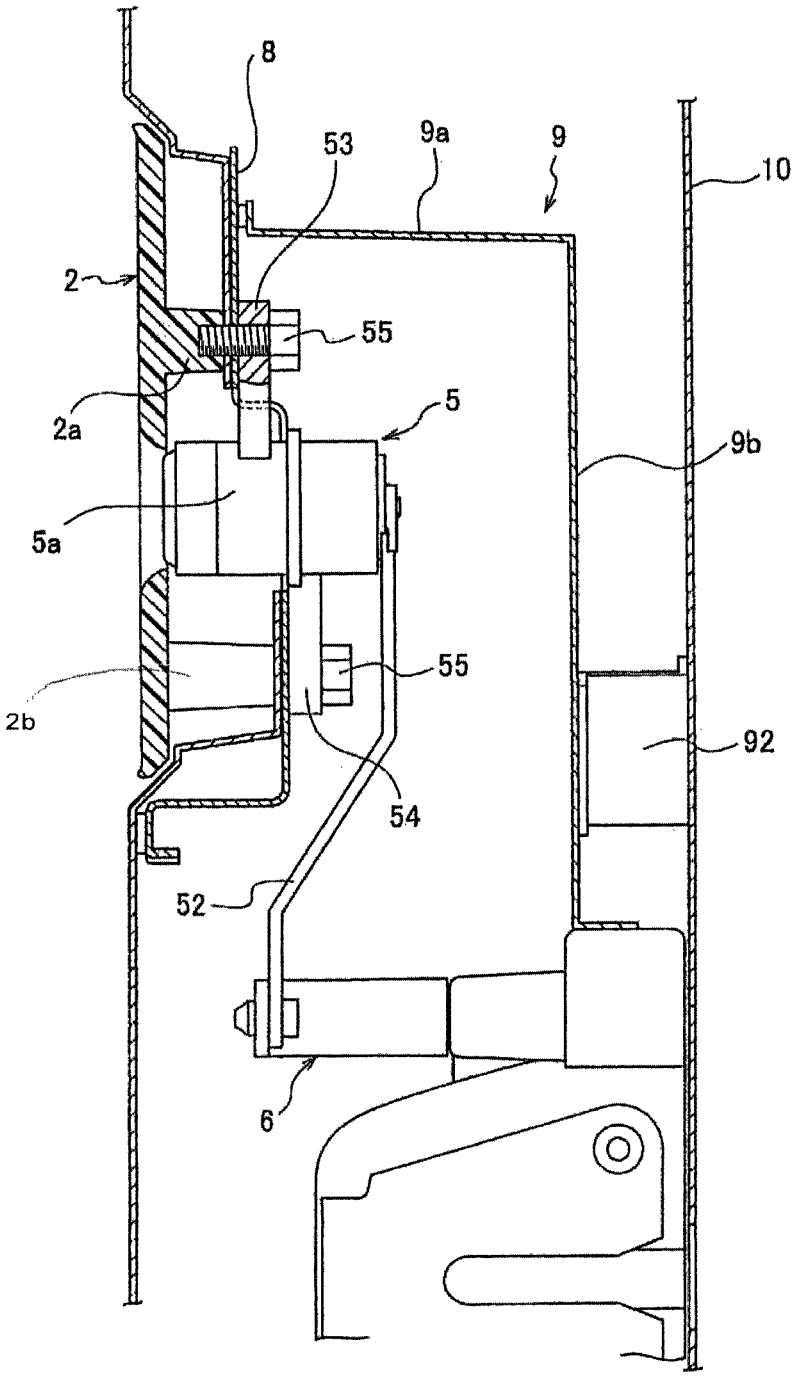
FIG. 6 is a cross-sectional view of the outside door handle cut along a vertical direction when seen from a rear side of a vehicle according to one embodiment of the present disclosure.

Further, the key cylinder protection bracket 8 may include threaded holes 81*b* and 81*c* above and below the engaging hole 81*a*. Installation flanges 53 and 54 may be integrally formed with the key cylinder 5. The installation flanges 53 and 54 may extend along upper and lower directions and may be provided with through-holes (not shown) for inserting bolts 55. After the bolts 55 are inserted into the through-holes of the installation flanges 53 and 54, the bolts 55 are inserted through the threaded holes 81*b* and 81*c*. As shown in FIG. 6, the escutcheon 2 includes bosses 2*a* and 2*b* protruding inward toward the vehicular inner side and having installation holes, and the bolts 55 may be threadedly engaged with the installation holes of the bosses 2*a* and 2*b*. Thus, the key cylinder 5 may be coupled with the escutcheon 2 via the key cylinder bracket 8 and bosses 2*a* and 2*b*.

Moreover, an extension 82 may be disposed at a periphery of the key cylinder protection bracket 8. The extension 82 may cover a periphery of the installing port 3*a* of door outer panel 3 (shown in FIG. 5) in the vehicular inner side by a predetermined range.

As shown in FIGS. 1 to 5, the extension 82 includes a step protruding toward the vehicular outer side along the outer periphery of the escutcheon 2 and flattened from such step along the door outer panel 3. An outer peripheral edge of such a flattened surface is bent toward the vehicular inner side.

Thus, the extension 82 forms an approximately L-shape defined by a vertical surface 82*a* extended along a generally up-and-down direction and a horizontal surface 82*b* extended along a generally horizontal direction. Further, as shown in FIG. 5, the extension 82 may contact the door outer panel 3 via a cushioning material CU interposed therebetween.

As discussed above, the installation flanges 53 and 54 may be coupled to the escutcheon 2 and the key cylinder protection bracket 8 by the bolts 55. Thus, the key cylinder 5 may be secured to the key cylinder protection bracket 8 by the installation flanges 53 and 54.

Also, as shown in FIGS. 3 and 4, a protector (or second protection bracket) 9 may be disposed at the vehicular inner side of the escutcheon 2. The protector 9 may cover the key cylinder 5 from above on the vehicular inner side. Accordingly, because the protruding leading end of the key cylinder 5, the key lever 51 and the key rod 52 may be covered by the protector 9. Thus, the doorlock may be prevented from being improperly released by incorrectly operating the key lever 51 or key rod 52 by inserting tools such as a screwdriver into a gap of a door window glass or into an inserting hole of the handle arm 4*a* between the door inner panel 10 and the door outer panel 3.

Because the outside door handle 1 may be disposed at the rear side of the door as shown in FIG. 5, the protector 9 may be disposed in a space between the door outer panel 3 and the door inner panel 10 at the rear side of the door.

As shown in FIGS. 3 and 4, the protector 9 may include a top surface 9*a*, a side surface 9*b* and a front surface 9*c*. The top surface 9*a* may extend from an upper end of the escutcheon 2 toward the inside of the vehicle. The side surface 9*b* may downwardly extend from an end edge of the inside of the top surface of the vehicle and may therefore be disposed substantially parallel to the door inner panel 10. The front surface 9*c* may be disposed at a front end of the top surface 9*a* and a front end of the side surface 9*b* and may extend along a vehicular width direction and an up-and-down direction. As such, the upper side, the vehicular inner side and the front side of the key cylinder 5 may be covered by the top surface 9*a*, the side surface 9*b* and the front surface 9*c* of the protector 9.

As shown in FIG. 4, a first installation bracket 91 provided with a weld nut 91*a* may protrude upward from an upper surface of a vehicular rear edge of the top surface 9*a* of the protector 9. As shown in FIG. 3, a second installation bracket 92 may be provided with a weld nut 92*a* and may protrude toward the vehicular inner side at a lower end of the side and front surfaces, 9*b* and 9*c*, of the protector 9. Further, the first installation bracket 91 may be coupled to a vehicle rear side wall 10*a* of the door inner panel 10 (shown in FIG. 5) by a bolt, and the second installation bracket 92 may be coupled to an outside-facing surface of the door inner panel 10 by a bolt.

Further, the protector 9 may be provided with supports 93 (shown in FIGS. 3 and 7) and 94 (shown in FIG. 4) to support the key cylinder protection bracket 8 when the key cylinder 5 is pressed from the vehicular outer side.

The supports 93 and 94 may be located at a plurality of positions (e.g., two positions in the present embodiment) at an appropriate distance.

Figure 7:
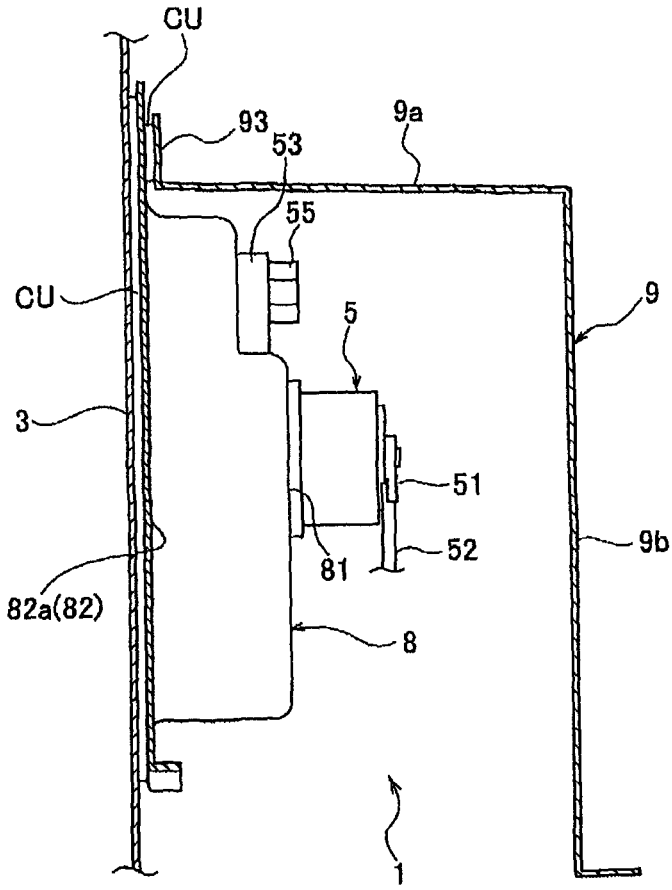
FIG. 7 is an expanded cross-sectional view along the line VII-VII of FIG. 3.

As shown in FIGS. 3 and 7, the support 93 at one side may be formed by the vehicular outer side leading end of the top surface 9*a* of the protector 9. The support 93 may contact an upper end of the longitudinal surface 82*a* of the extension 82 of the key cylinder protection bracket 8 via the cushioning material CU interposed therebetween. That is, the longitudinal surface 82*a* (extension 82) may be interposed between the support 93 and the door outer panel 3.

As shown in FIG. 4, the support 94 at the other side may be formed by cutting a recess into vehicular outer side edge of the front surface 9*c* of the protector 9 corresponding to an up-and-down width of the horizontal surface 82*b* of the extension 82. The horizontal surface 82*b* may be fitted into the support 94 so that the front surface 9*c* covers the horizontal surface 82*b* from the vehicular inner side. Further, the key cylinder 5 may be disposed on a straight line connecting the supports 93 and 94 at two positions or therearound.

With such a configuration, although a pressing load is exerted upon the key cylinder 5 from a vehicular outer side toward the vehicular inner side, the key cylinder 5 and the key cylinder protection bracket 8 may be restrained from moving toward the vehicular inner side as explained below.

When a load is exerted upon the key cylinder 5 toward the vehicular inner side, such a load may be transferred to the key cylinder protection bracket 8 via the installation flanges 53 and 54 which may press the key cylinder protection bracket 8 toward the vehicular inner side. The load transferred from the key cylinder 5 to the key cylinder protection bracket 8 may then be transferred to the protector 9 via the supports 93 and 94 to thereby press the protector 9 toward the vehicular inner side. Although the load transferred to the protector 9 is transferred to the door inner panel 10 via the first and second installation brackets 91 and 92, such a load may be received by the door inner panel 10. As such, even when the pressing load is exerted upon the key cylinder 5 toward the vehicular inner side, the key cylinder 5 and the key cylinder protection bracket 8 may be restrained from moving toward the vehicular inner side.

Also, because the key cylinder 5 may be disposed on the straight line connecting the supports 93 and 94, the pressing load exerted upon the key cylinder 5 may be approximately and evenly received by the supports 93 and 94 at two positions. Thus, the supporting stability of the protector 9 may be improved.

According to the structure of the outside door handle of embodiments, disclosed herein, because the key cylinder protection bracket 8 may prevent the key cylinder 5 from being displaced along a direction perpendicular to a shaft of the key cylinder 5, an improper release of the doorlock by inserting a screwdriver into the key hole may be prevented.

Further, according to the structure of the outside door handle of embodiments, disclosed herein, because the protector 9 may cover above where the key cylinder 5 protrudes from the escutcheon 2 toward the vehicular inner side, unauthorized access to the key lever 51 and the key rod 52 by the protruding leading end of the key cylinder 5 may be prevented by the protector 9.

Also, according to the structure of the outside door handle of embodiments, disclosed herein, when the pressing load is exerted upon the key cylinder 5 toward the vehicular inner side, the key cylinder 5 and the key cylinder protection bracket 8 may be restrained from moving toward the vehicular inner side.

Thus, as shown in FIG. 8, even when the key cylinder 5 is impacted with a hammer H from the vehicular outer side, the escutcheon 2 around the key cylinder 5 may be prevented from being dislocated.

Further, according to the structure of the outside door handle of embodiments, disclosed herein, because the supports 93 and 94 may be disposed at two spots at an appropriate distance, the protector 9 can be stably supported at the door inner panel 10 against the load exerted upon the protector 9 from the vehicular outer side direction (i.e., the pressing load of the key cylinder 5 caused by the hammer). It should be noted herein that the supports should not be limited to two spots but may be disposed at three or more spots. The supporting stability of the protector 9 may be improved by increasing the number of the spots where the supports are disposed.

Also, according to the structure of the outside door handle of embodiments, disclosed herein, because the key cylinder 5 may be disposed on the straight line connecting the supports 93 and 94 at two spots or therearound, the pressing load exerted upon the key cylinder 5 may be evenly received by the supports 93 and 94 at two spots. Thus, the supporting stability of the protector 9 may be improved.

According to the structure of the outside door handle of the embodiments, disclosed herein, the extension 82 covering the vehicular inner side periphery of the installing port 3*a* (shown in FIG. 5), which inserts the escutcheon 2 into the periphery of the key cylinder protection bracket 8, may be provided throughout a predetermined range. Therefore extension 82 overlaps installing port 3*a* and undesired access to the vehicle can be deterred by the extension 82. As such, it can be effective for preventing unauthorized access, and potential theft, by inserting a screwdriver or similar object into the periphery of the escutcheon 2.

Further, according to the structure of the outside door handle of embodiments, disclosed herein, the support 93 at one side may be disposed in the extension 82 (longitudinal surface 82*a*) of the key cylinder protection bracket 8, and the extension 82 may be interposed between the support 93 and the door outer panel. Thus, it is possible to increase the strength of the door outer panel 3 at the periphery of the escutcheon 2. As such, a dislocation at the time of pressing the screwdriver can be restrained, thereby being more effective in preventing undesired access and theft.

Also, because the support 93 may contact the key cylinder protection bracket 8 via the cushioning material CU, the pressing load from the key cylinder protection bracket 8 may be received by the protector 9 with a cushioning property. Thus, despite the impact load with a rapid pressing load, the protector 9 may not be dislocated or damaged.

As shown in FIG. 6, because the installing flanges 53 and 54, which may be used to install the key cylinder 5 in the escutcheon 2, are spaced apart from the surface of the escutcheon 2 toward the vehicular inner side, a bending moment needed to dislocate the key cylinder 5 may be increased. Thus, it becomes difficult to dislocate the key cylinder 5.

Further, according to the structure of the outside door handle shown, receiver 7 of the keyless entry may be disposed at the vehicle bottom side of the vehicular inner side of the escutcheon 2. Therefore, in selected embodiments, escutcheon 2 may be formed of synthetic resin so that keyless entry may function normally and without interference of RF signals that might otherwise result if escutcheon 2 were formed of a metallic material.

Advantageously, the present disclosure provides a structure of an outside door handle of a vehicle, comprising: a key cylinder for locking and releasing a doorlock; a key cylinder protection bracket disposed in a vehicular inner side of an escutcheon and being provided with an engaging hole for inserting a vehicular outer end of the key cylinder; and a protector disposed between the key cylinder protection bracket and a door inner panel and having a support for receiving a load when the load is exerted upon the key cylinder protection bracket toward the vehicular inner side. When a load exerted toward the vehicular inner side is exerted upon the key cylinder, such a load is transferred from the key cylinder protection bracket via the support to the protector and then received by the door inner panel.

According to the present disclosure, any movement of the key cylinder protection bracket toward the vehicular inner side is prevented by the support of the protector coupled to the door inner panel. As such, although the key cylinder is impacted by a hammer and the like, the escutcheon around the key cylinder is not destroyed, thereby reducing chances of burglaries.

Further, although the present invention has been disclosed with reference to the above embodiments, the present invention is not limited to such a configuration and may include other embodiments and modifications without deviating from the subject matter or scope of the present disclosure. The present disclosure will be effective in the case of a structure of an outside door handle disposing a key cylinder for locking and releasing a doorlock at a vehicular inner side of the escutcheon.

What is claimed is:

1. An outside handle assembly of a vehicle door having an inner panel and an outer panel, the handle assembly comprising:

an escutcheon disposed in the outer panel of the vehicle door;

a handle body disposed at a vehicular outer side of the escutcheon;

a first protection bracket disposed at the vehicular inner side of the escutcheon, the first protection bracket comprising an engaging hole configured to receive a key cylinder; and a second protection bracket disposed at the vehicular inner side of the escutcheon to cover a periphery of the key cylinder, wherein the second protection bracket is supported by the inner panel of the vehicle door via a second installation bracket, and comprises at least one support contacting the first protection bracket, wherein the second protection bracket is arranged to receive an impact load exerted upon the first protection bracket toward the vehicular inner side and arranged to restrain the key cylinder and the first protection bracket from moving toward the vehicular inner side, wherein the outer panel of the vehicle door comprises an installation port configured to receive the handle assembly, and wherein the first protection bracket comprises an extension to cover at least a portion of a vehicular inner side periphery of the installation port.

2. The handle assembly of claim 1, wherein the impact load exerted upon the key cylinder toward the vehicular inner side is transferred from the first protection bracket through the at least one support and the second protection bracket to the inner panel of the vehicle door.

3. The handle assembly of claim 1, wherein the second protection bracket comprises a plurality of supports disposed in a straight line connecting the key cylinder.

4. The handle assembly of claim 1, further comprising a cushioning material disposed between the first protection bracket and the at least one support.

5. The handle assembly of claim 1, wherein the key cylinder includes at least one installing flange spaced apart from a vehicular inner side surface of the escutcheon.

6. A method to protect an outside door handle assembly of a vehicle door, the method comprising:

disposing an escutcheon in an outer panel of the vehicle door;

disposing a handle body at a vehicular outer side of the escutcheon;

disposing a first protection bracket at the vehicular inner side of the escutcheon;

disposing a second protection bracket at the vehicular inner side of the escutcheon to cover a periphery of a key cylinder;

supporting the second protection bracket to an inner panel of the vehicle door via a second installation bracket;

contacting the first protection bracket with at least one support of the second protection bracket;

receiving the outside door handle assembly in an installation port of the outer panel of the vehicle door; and covering an inner periphery of the installation port with an extension of the first protection bracket, wherein the second protection bracket is arranged to restrain the key cylinder and the first protection bracket from moving toward the vehicular inner side.

7. The method of claim 6, further comprising transferring an impact load from the first protection bracket to the second protection bracket when the impact load is applied to the key cylinder.

8. The method of claim 7, wherein an impact load applied to the key cylinder toward the vehicular inner side is transferred from the first protection bracket through the at least one support and the second protection bracket to the inner panel of the vehicle door.

9. The method of claim 6, wherein the second protection bracket comprises a plurality of supports substantially in a straight line connecting the key cylinder.

10. The method of claim 6, further cushioning a contact region between the first protection bracket and the at least one support.

11. A handle assembly of a vehicle door having an inner panel and an outer panel, the handle assembly comprising:

an escutcheon disposed in the outer panel of the vehicle door;

a handle body disposed at a vehicular outer side of the escutcheon;

a first means for protecting a key cylinder disposed at the vehicular inner side of the escutcheon, the first protecting means comprising an engaging hole configured to receive the key cylinder; and a second means for protecting the key cylinder disposed at the vehicular inner side of the escutcheon to cover a periphery of the key cylinder, wherein the second protecting means is supported by the inner panel of the vehicle door via a second installation bracket, and comprises at least one support contacting the first protecting means, wherein the second protecting means is arranged to receive an impact load exerted upon the first protecting means toward the vehicular inner side and arranged to restrain the key cylinder and the first protecting means from moving toward the vehicular inner side, wherein the outer panel of the vehicle door comprises an installation port configured to receive the handle assembly, and wherein the first means for protecting the key cylinder comprises an extension to cover at least a portion of a vehicular inner side periphery of the installation port.

12. The handle assembly of claim 11, wherein the impact load exerted upon the key cylinder toward the vehicular inner side is transferred from the first protecting means through the at least one support and the second protecting means to the inner panel of the vehicle door.

13. The handle assembly of claim 11, further comprising a means for cushioning disposed between the first means for protecting and the at least one support.

* * * * *